US006010000A

United States Patent [19]

Tran

[11] Patent Number: 6,010,000

[45] Date of Patent: Jan. 4, 2000

[54] ALBUM SLIP CASE WITH DISPLAY RETAINER

[76] Inventor: Lam H. Tran, 7525 Oaktree Ave., Westminster, Calif. 92683

[21] Appl. No.: 09/283,859

[22] Filed: Apr. 1, 1999

[51] Int. Cl.[7] ..... B65D 5/00

[52] U.S. Cl. ..... 206/424; 206/776; 206/457

[58] Field of Search ..... 206/424, 775, 206/776, 777, 778, 459.5, 457

[56] References Cited

U.S. PATENT DOCUMENTS 4,703,854 11/1987 Cline ..... 206/424
4,739,353 4/1988 Heuer et al. ..... 206/776 X

*Primary Examiner*—Jacob K. Ackun
*Attorney, Agent, or Firm*—Charles H. Thomas

[57] ABSTRACT

A photo album case or other storage container is formed with an outer shell having laterally enclosing walls and an end panel opposite an open end to the shell. At least one display panel is formed in the shell and a window is defined in the display panel. A stiff, inner display retainer is inserted into the open end of the shell and fits into the storage cavity defined within the shell. The display retainer conforms to the shape of at least the display panel wall. The display retainer extends beyond the display wall to extend across another of the inner surfaces immediately adjacent thereto. A visual display sheet, such as a photographic print, is located between the display wall and the display retainer. The display sheet may be merely inserted in between the display wall and the display retainer, or it may be mounted upon either the retainer or the inner surface of the display panel wall. In any of these arrangements the display retainer presses against the inner surface of the display wall and against another of the inner surfaces of the shell immediately adjacent thereto. The retainer thereby hold the visual display sheet firmly against the inner surface of the display wall in the area surrounding the window therein. The visual display sheet thereby provides an indicia of the contents of the storage container.

20 Claims, 8 Drawing Sheets

ALBUM SLIP CASE WITH DISPLAY RETAINER

BACKGROUND OF THE INVENTION

1. Field of the Invention

The present invention relates to a photo album case or other storage container having a shell into which an album or other storage media slides.

2. Description of the Prior Art

Conventional photograph albums and other document storage devices are often provided with cases which receive the photo album or other storage medium therewithin. The storage medium may be a photo album, diary, notebook, account book, book of corporate records, or other article in which photographs, documents, keys, or other articles are stores. The case is typically formed with one closed end panel, wall panels laterally surrounding the closed end panel, and an open end opposite the closed end panel. The photo album or other binder or article containing the items to be stored slips into the shell through the open end and seats in abutting relationship against the opposite, closed end of the case.

In conventional photo albums or other storage cases the manufacturer sometimes provides a preprinted indicia across the closed end of either the spine of the album, the closed end of the case, or both, to aid the user in identifying the contents of the case. However, any such preprinted indicia is typically so general as to be of little value to the user.

SUMMARY OF THE INVENTION

The present invention relates to an improved slip case for photo albums or other binders that provides the user with a custom made content identification sheet that may be easily applied and which will withstand extensive use. Moreover, the custom identification sheet may be readily changed by the user for purposes of updating or alteration of the contents of the album housed within the case.

In one broad aspect the present invention may be described as a storage container comprising: an outer shell formed with laterally enclosing walls having inner and outer surfaces and opposing open and closed ends, wherein the shell includes a transverse, closed end panel having inner and outer surfaces and extending across the closed ends of the laterally enclosing walls, thereby defining a storage cavity therewithin. The open ends of the walls form and surround an open entry to the storage enclosure. At least one of the walls is a display wall within which a window is formed. The storage container of the invention also includes a stiff, inner display retainer that fits into the storage cavity and which conforms to the shape of the inner surface of the display wall. The display retainer also extends beyond the display wall to extend across another of the inner surfaces immediately adjacent thereto. A visual display sheet is located between the display wall and the display retainer. The display retainer presses against the inner surface of the display wall and the other inner surfaces immediately adjacent thereto across which the display retainer also extends. The display retainer holds the visual display sheet firmly against the area of the inner surface of the display wall surrounding the window therein.

The outer shell of the storage container may take a number of different forms. For a photo album display case the outer shell of the storage container is typically formed in the shape of a hollow, rectangular prism having one open end and one closed end. The shell or slip case may be made of different materials, such as die cut stiff paper, plastic sheet stock, or injection-molded plastic. It may also be formed as an alloy casting, of cold forged metal, a ceramic or porcelain material, or bent sheet metal. The shell can also be formed of wood or cardboard. It is important for the outer shell of the storage container to be reasonably stiff and to be open at one end or edge to receive the contents of the storage container, which is typically an album or binder of some sort.

The window formed in the display wall preferably occupied less than the total area of the display wall and is defined entirely therewithin, so that the remaining structure of the display wall forms a border around the periphery of the viewing window. The viewing window is preferably more or less centered within the display wall.

The display retainer may likewise be fabricated from a number of different materials. For example, it may be formed from a single sheet of die cut stiff paper or plastic stock. The retainer has at least one fold extending thereacross so as to delineate a display retaining panel and an adjacent support panel. The display retaining panel is disposed to face the inner surface of the display wall panel. At least one support panel projects from the display retaining panel and is disposed to face one of the inner surfaces of the shell immediately adjacent the display wall panel.

In a preferred embodiment of the invention the retainer includes a pair of mutually parallel folds that are separated from each other by a distance equal to the width of the closed end panel. The area of the retainer between the folds in the pair of folds serves as a web support panel. The retainer is then inserted into the shell with its central, web support panel disposed in a face-to-face relationship with the closed end panel of the shell. The web support panel is located between the retainer display panel on one side and another support panel extending outwardly toward the open end of the shell from the other side of the web support panel. When the stiff, inner display retainer is formed of a single sheet of stiff stock, folded in this fashion, the resiliency of the structure of the stock forming the retainer is normally sufficient to urge the display retaining panel and the support panel located opposite the display retaining panel on the other side of the web support panel toward the display wall and an opposing wall, respectively.

The visual display sheet may likewise take several forms. The visual display sheet may be a printed sheet of paper or card stock, a photograph, a title sheet, or any other thin, sheet-like structure upon which some indicia of the contents of the storage container is printed or inscribed. The visual display sheet may be of a size equal to the size of both the area bounded by the inner surface of the display wall and the area of the retainer display panel. That is, the visual display sheet may extend both the length and breadth of the entire display wall and display retaining panel.

Alternatively, however, the visual display sheet may be of a size somewhat smaller than both the display wall and the display retaining panel. When the visual display sheet is smaller than these surfaces, some type of mounting is employed to mount the visual display sheet on either the display retaining panel or on the inside surface of the display wall. For example, corner slits may be cut into the display retaining panel to receive the corners of the visual display sheet. The visual display sheet is thereby mounted on the display retaining panel and is preferably centered within the viewing window of the display wall panel of the shell. In this case, the visual display sheet should be somewhat larger than the visual display window and is centered relative to the visual display window so that no portion of the retainer is visible through the visual display window from outside the storage container shell.

The visual display sheet may be mounted on the retainer in other ways, as well. For example, some, but not all, of the peripheral edges of a transparent sheet of pocket material may be secured to the outwardly facing surface of the display retaining panel. The transparent sheet may be secured to the display retaining panel by heat sealing, glue, double-sided adhesive tape, or staples. Also, the visual display sheet may be mounted directly on the retainer by means of double-sided adhesive tape, by tape at the corners or edges, by photograph corner mounts, by glue, heat sealing or staples, and other available mounting systems. Whatever the form of attachment, the visual display sheet is inserted in between the transparent mounting sheet and the display retaining panel so as to be visible through the transparent pocket created therebetween.

Preferably, also the shell is provided with catch members at the open end of the display wall panel and at the open end of at least one other of the wall panels so as to engage the retainer and hold it within the shell. The catch mechanism may take the form of a restraining tab having an anchored end secured to the open end of one of the walls and a free end directed toward the closed end panel. With this construction the catch member engages and retains an edge of the display retainer.

Alternatively, the catch member may be formed by raised lips secured to the inner surfaces of inner ends of at least one of the walls of the shell. The display retaining panel and the support or bracing panel have outer edges that reside in abutment against the raised lips. The raised lips thereby prevent the edges of the album or binder from catching on the edges of the retainer when the album or binder is inserted into the shell of the case.

In another aspect the invention may be considered to be an album case comprising a shell, a stiff display retainer, and a display sheet. The shell has a closed end with an end panel having inner and outer surfaces, an opposite open end, and a plurality of wall panels having inner and outer surfaces and extending between the closed end panel and the open end. At least one of the panels of the shell is a display panel in which a window is defined. The stiff display retainer has a plurality of distinct, flat retainer panels joined together. One of these panels is coextensive in area with and presses against the inner surface of the display panel. Another of these retainer panels extends across and presses against the inner surface of another of the wall panels of the shell immediately adjacent to the display panel. A display sheet is interposed between the inner surface of the display panel and the retainer panel that presses against the inner surface of the display panel.

The invention may be described with greater clarity and particularity with reference to the accompanying drawings.

DESCRIPTION OF THE EMBODIMENT

Figure 1:
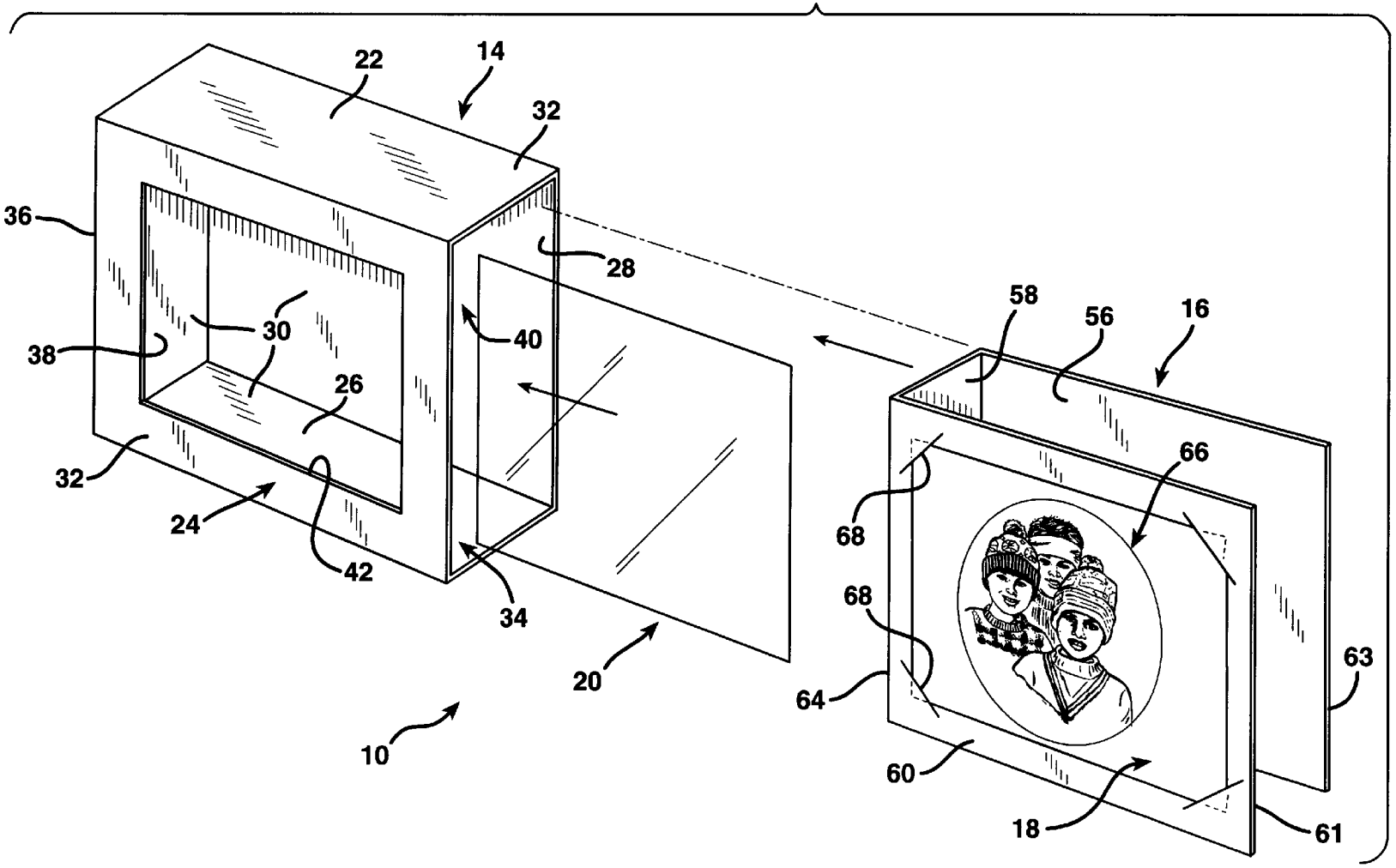
FIG. 1 is an exploded, perspective view illustrating one preferred embodiment of a storage container constructed according to the invention.
Figure 2:
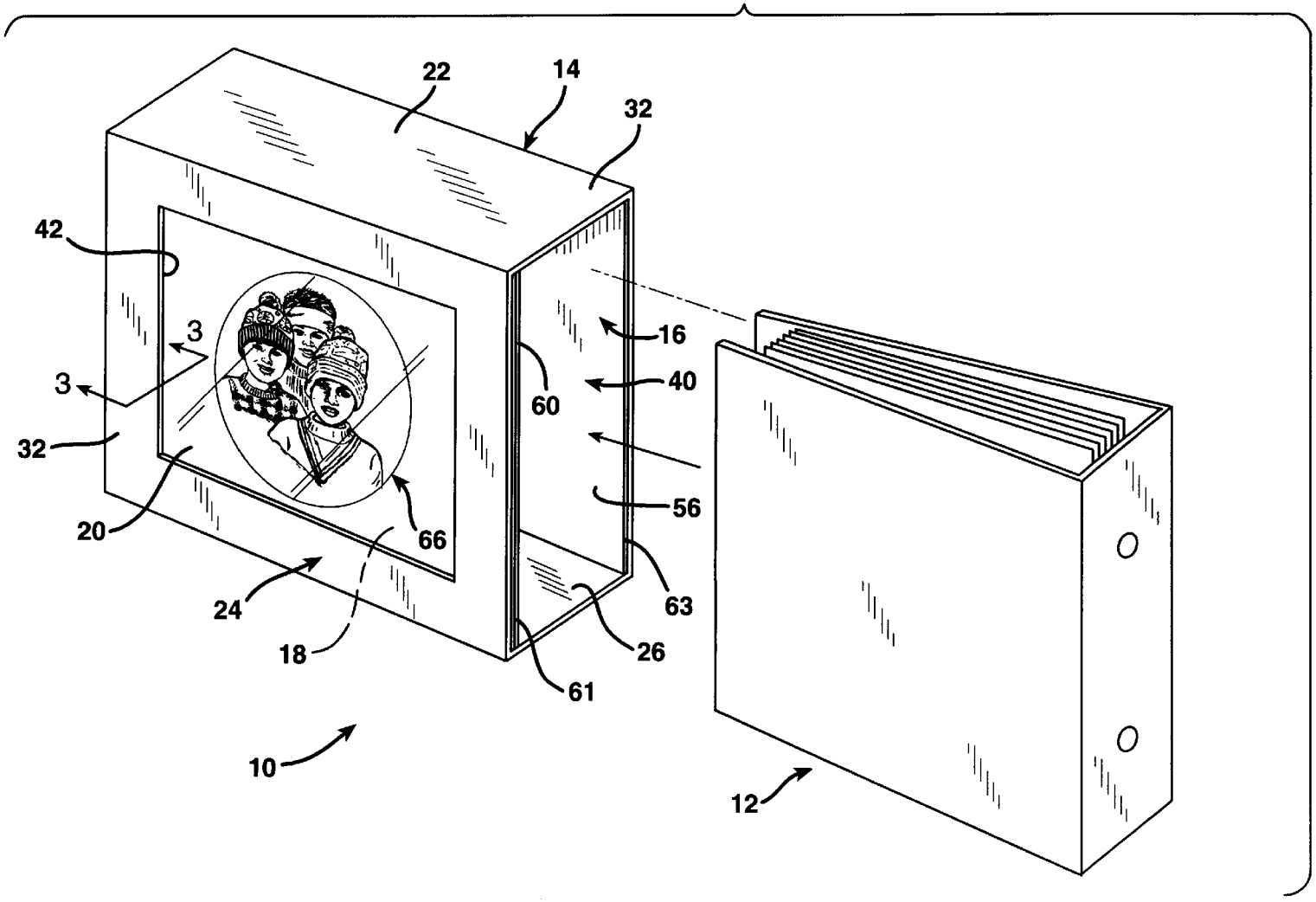
FIG. 2 is a perspective view illustrating the component parts of the storage container of FIG. 1 assembled together in preparation for receipt of a photo album.

FIGS. 1 and 2 illustrate a photo album case 10 adapted to receive and store a photo album 12. The photo album case 10 is comprised of a shell 14, a stiff display retainer 16, a display sheet 18, and an optional transparent, protective sheet 20.

The photo album shell 14 is formed from a single sheet 43 of stiff card stock or plastic, shown in a flattened condition prior to fabrication of the shell 14. When constructed, the shell 14 has four rectangular wall panels 22, 24, 26, and 28 having inner surfaces 30 and outer surfaces 32. The shell 14 has an open end 34 and a closed end 36. At its closed end 36 the shell 14 has a rectangular closed end panel 38, which like the wall panels has an inner surface 30 and an outer surface 32. Each of the wall panels 22, 24, 26, and 28 has an open end, which forms and defines the open end 34 of the shell 14, and a closed end to which the closed end panel 38 is secured. The closed end panel 38 extends transversely across all of the closed ends of the wall panels 22, 24, 26, and 28. As illustrated in FIGS. 1 and 2, the shell 14 defines a hollow album enclosure indicated generally at 40.

At least one of the wall panels 22, 24, 26, and 28 is a display wall panel. In the embodiment depicted in FIGS. 1–2, the shell 14 has but a single display wall panel, which is the display wall panel 24. A window 42 is defined within the structure of the display wall panel 24 so that the remaining structure of the display wall panel 24 forms a rectangular frame or border around the window 42.

Figure 4:
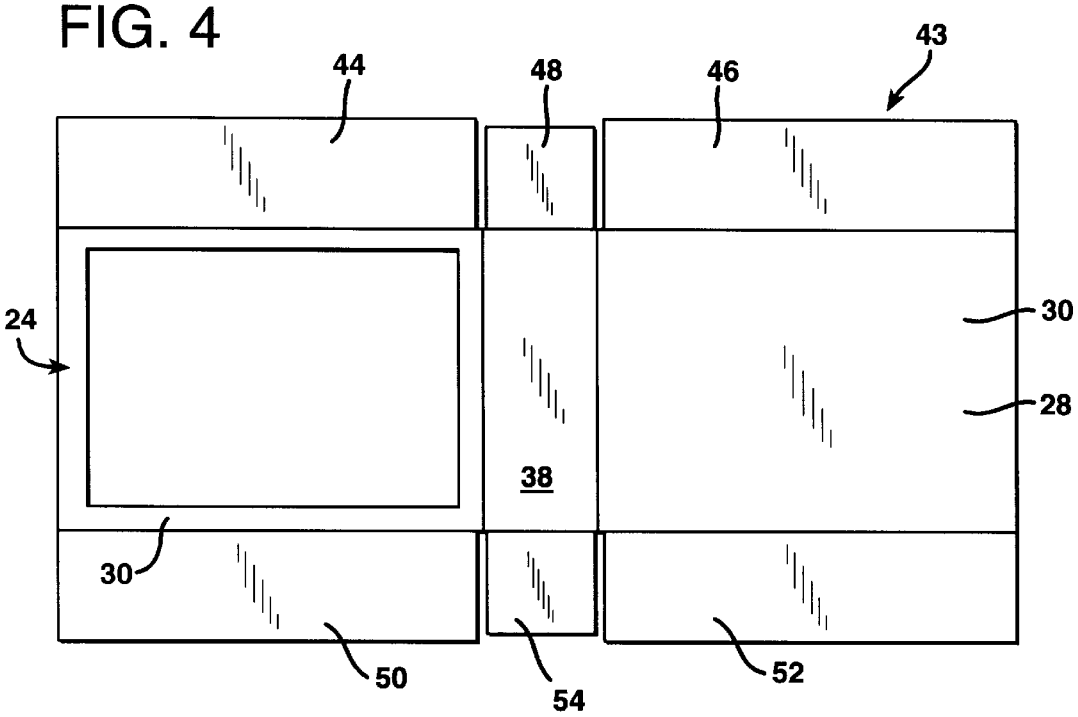
FIG. 4 is a plan view illustrating the structure of the outer shell of the storage container of FIGS. 1–2 in a flattened condition.

The single sheet 43 of stiff, flat card stock or plastic that forms the shell 14 is illustrated in a flattened condition, prior to assembly of the shell 14, in FIG. 4. As shown in that drawing figure, the closed end panel 38 lies between the display wall panel 24 and the rectangular opposing wall panel 28, which lies opposite the display wall panel 24 when the shell 14 is assembled as depicted in FIGS. 1 and 2. The top wall panel 22 is formed by a pair of relatively narrow wall panel flaps 44 and 46 which extend, respectively, from the upper edges of the display wall panel 24 and the opposing wall panel 28. A square flap 48 at the top of the closed end wall panel 38 also forms a part of the top wall panel 22. Specifically, when the flat card stock sheet 43 is folded from its flattened condition depicted in FIG. 4, the flap 44 forms the inner surface of the top wall panel 22, while the other top flap 46 forms the outer surface of the top wall panel 22. The flap 48 is sandwiched in between or beneath the flaps 44 and 46. The flaps 44, 46, and 48 are secured to each other by an adhesive applied on both sides of the flap 48 and by adhesive between the mutually facing concealed surfaces of the flaps 44 and 46.

Similarly, the bottom wall panel 26 is formed by flaps 50 and 52 which extend respectively from the lower edges of the display wall panel 24 and the opposing wall panel 28. Another square flap 54 projects from the lower edge of the closed end wall panel 38. The exposed surface of the flap 50 forms the inner surface 30 of the bottom wall panel 26, while the exposed surface of the flap 52 forms the outer surface of the bottom wall panel 26. Adhesive is applied to both sides of the square flap 54, which is sandwiched in between the flaps 50 and 52. Adhesive is also applied to the portions of the flaps 50 and 52 which face and contact each other. When the adhesive has been applied to the flaps as described, and the flaps 44 and 46 have been folded into contact with each other and with the flap 48 and the flaps 50 and 52 have been folded into contact with each other and with the flap 54, as described, the shell 14 is formed so that the storage cavity 40 has the shape of a rectangular prism, as illustrated in FIG. 1.

The order of folding the flaps is a matter of preference. For example, the flaps 48 and 54 may be folded in first and form portions of the inner surface 30 of the upper and lower panels 22 and 26. Also, when the nature of the materials permits, the flaps can be attached together by heat sealing or sonic welds.

Figure 5:
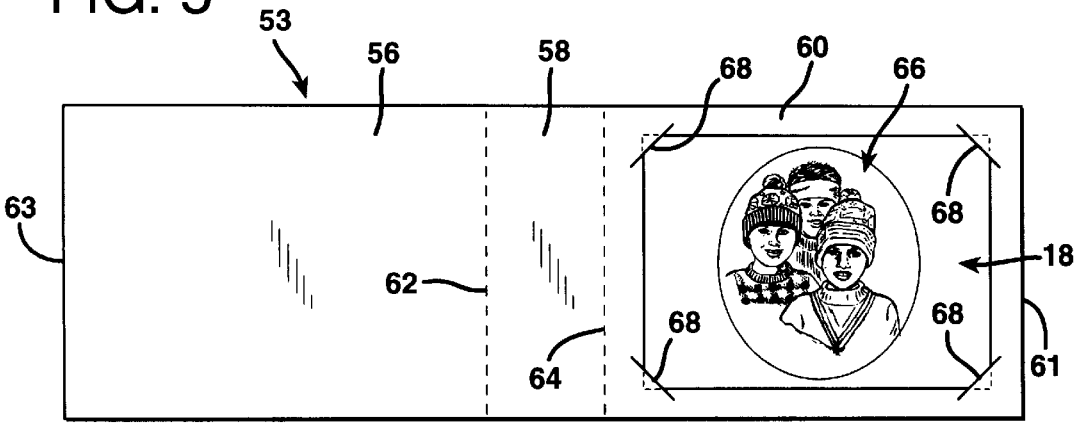
FIG. 5 is a plan view illustrating the retainer of the storage container of FIGS. 1–2 in a flattened condition and with the visual display sheet mounted thereon.

The display retainer 16 is also formed from a single sheet of flat, stiff material 53, such as card stock or plastic, illustrated in a flattened form in FIG. 5. The sheet of material 53 forming the retainer 16 is delineated into distinct, rectangular container panels by at least one liner fold. In the embodiment of FIGS. 1 and 2, the retainer 16 is formed of three rectangular panels 56, 58, and 60 by a pair of mutually parallel folds 62 and 64. The sheet of flat stock forming the retainer 16 is bent into a U-shaped configuration at the folds 62 and 64 which serve as articulated joints between the discrete retainer panels 56, 58, and 60.

The retainer panel 60 serves as a display retaining panel for mounting the display sheet 18, which in the embodiment depicted is a sheet containing a photograph 66. The fold 64 forms an articulated joint between the display retaining panel 60 and the adjacent, narrower panel 58, which serves as a web support panel. The web support panel 58 has a width, as measured between the folds 62 and 64, nearly equal to the width of the inner surface 30 of the closed end panel 38 of the shell 14. The fold 62 delineates the web support 58 from a return or bracing panel 56 that has the same dimensions as the display retaining panel 60 and which is located directly opposite therefrom when the retainer 16 is in use, as depicted in FIGS. 1 and 2.

Diagonal mounting slits 68 are die cut into the structure of the display retaining panel 60 near the corners thereof. The visual display sheet 18 is a rectangular sheet of photographic paper formed with corners which are inserted through the mounting slits 68 in the retainer 16, as illustrated in FIGS. 1 and 5. The mounting slits 68 in the retainer 16 provide a mechanism for mounting the visual display sheet 18 upon the retainer 16, centered within the display retaining panel 60.

Figure 3:
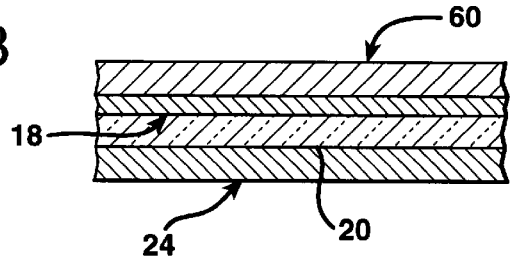
FIG. 3 is a transverse sectional detail taken along the lines 3—3 of FIG. 2.

In the embodiment illustrated in FIGS. 1 and 2, the storage container 10 is further comprised of a rectangular sheet 20, formed of stiff, transparent material, such as a sheet of transparent Mylar® or polyethylene. The upper and lower edges of the transparent protective sheet 20 are equal in length to the longitudinal length of the interior surfaces 30 of the wall panels 22, 24, 26, and 28, as measured between the inner surface 30 of the closed end panel 38 and the open end 34 of the shell 10. The side edges of the protective sheet 20 are equal in length to the height of the display wall panel 24. The transparent, protective sheet 20 is interposed between the inner surface 30 of the display wall panel 24 and the outwardly facing surface of the visual display sheet 18, as best indicated in FIG. 3.

The sheet of stiff, resilient sheet material 53 that is divided into the display retaining panel 60, the support web panel 58, and the opposing, return panel 56 is divided by the folds 62 and 64 which form linear, articulated connections between the panels 56, 58, and 60. When the retainer 16 is bent along the folds 62 and 64, it assumes basically a U-shaped configuration, but due to the resiliency of the sheet from which they are formed, the retainer panels 56, 58, and 60 are resiliently biased apart from each other with a slight force. The retainer 16 fits into the storage cavity 40 and conforms to the shape of and covers the inner surface 30 of the display wall 24. The web support panel 58 of the display retainer 16 extends beyond the display wall 24 to extend completely across another of the inner surfaces 30 of the shell 14 immediately adjacent thereto. Specifically, in the embodiment of FIGS. 1 and 2, the web support panel 58 of the retainer 16 extends completely across the inner surface 30 of the closed end panel 38 of the shell 14 and resides in contact therewith.

The display retaining panel 60 is coextensive in surface area with the area encompassed by the inner surface 30 of the display wall panel 24. The web support panel 58 is coextensive in surface area with the inner surface 30 of the closed end panel 38. The web support panel 58 is located immediately adjacent to the display retaining panel 60. The return panel 56 of the retainer 16 is coextensive in surface area with the wall panel 28 of the shell 14 that lies directly opposite the display panel 24 thereof.

As illustrated in FIG. 1, the album case 10 is assembled by first mounting the visual display sheet 18 on the display retaining panel 60. The transparent, protective sheet 20 is then inserted into the shell enclosure 40 by sliding it along the inside surface 30 of the display panel 24 until it abuts against the closed end panel 38 of the shell 14. The retainer 16, with the visual display sheet 18 mounted thereon, is next inserted into the shell enclosure 40 with the web support panel 58 facing the closed end panel 38 of the shell 14. The U-shaped retainer 16 is inserted so that the display retaining panel 60 and the visual display sheet 18 mounted thereon slide along the inside surface of the transparent protective sheet 20. When the retainer 16 has been fully and completely inserted into the shell 14, the web support panel 58 resides in face-to-face abutment against the transverse shell end panel 38.

The display retaining panel 60 of the retainer 16 conforms to the shape and completely covers the inner surface 30 of the display wall 24 of the shell 14. The display retaining panel 60 has a perimeter that is coextensive with the perimeter of the display wall panel 24. The web support panel 58 extends beyond the display retaining panel 60 and completely covers the inner surface 30 of the transverse end panel 38 of the shell 14 immediately adjacent to the display wall 24. The web support panel 58 is coextensive in area with the inner surface 30 of the end panel 38 of the shell 14 immediately adjacent the display wall panel 24. The bracing or return panel 56 is joined to the web support panel 58 and resides in contact with the back wall 28 of the shell 14, which is parallel to and located opposite the display wall 24.

The resiliency of the sheet 53 from which the retainer 16 is constructed, and the frictional fit of the top and bottom edges of the display retaining panel 60 and the return panel 56 hold the panels 60 and 56 pressing outwardly, respectively, against the shell display wall 24 and the opposing shell wall 28. The retainer 16 thereby forms a liner within the shell enclosure 40. A photographic album 12 can then be inserted into the enclosure 40 within the embrace of the display retaining panel 60 and the return panel 56 in the manner depicted in FIG. 2.

As is evident from FIG. 2, the photograph 66 of the photographic visual display sheet 18 is highly visible through the window 42 of the display wall 24, but is protected from fingerprints and other soiling by the transparent protective sheet 20. The photograph 66 provides a ready indication of the contents of the photo album 12, since the selection of the visual display sheet 18 is totally within the discretion of the owner of the album 12.

It can be seen that any number of different types of visual display sheets may be mounted in the retainer 16. Instead of the photographic display sheet 18 depicted, the user may wish to insert instead a title page or table of contents consisting entirely of text material. Also, it is quite easy for the user to remove and replace the visual display sheet 18 with an updated or substitute version of it. The identifying sheet, visible externally from the photo album case 10 allows the user to readily ascertain the contents of the photographic album 12 with merely a glance at the album case 10.

When the retainer 16 is inserted into the shell 14, the top and bottom edges of all of the retainer panels 56, 58, and 60 reside in contact with the inner surfaces 30 of the top side wall panel 22 and the bottom side wall panel 26 of the shell 14. The tight fit, coupled with the outwardly acting flexure of the end retaining panels 56, and 60 from the central web support panel 58 are normally sufficient to hold the outer edges of the retaining panels 56 and 60 apart to prevent them from interfering with the insertion of the photograph album 12 into the storage enclosure 40. However, as a further safeguard, it is sometimes advisable to provide the shell 14 with at least one catch member at the open end 34 thereof to engage the display retainer 16 and hold it within the storage cavity 40 pressed against at least some of the inner surfaces 30 of the shell 14.

Figure 6:
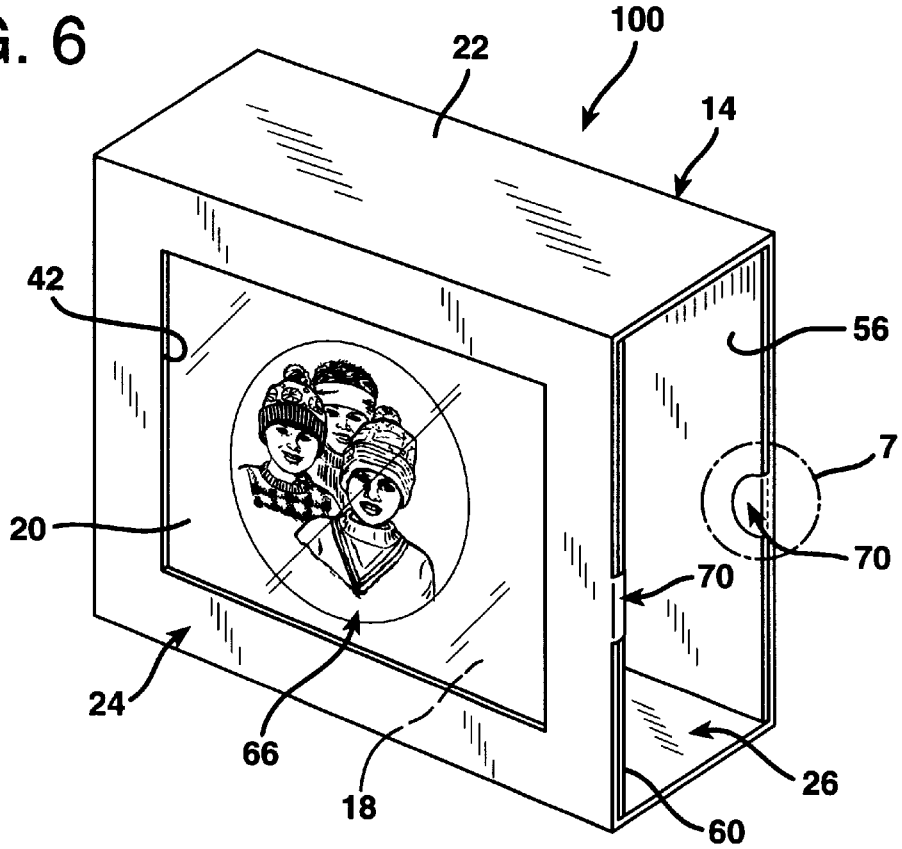
FIG. 6 is a perspective view of an alternative embodiment of the storage container of FIG. 2.
Figure 7:
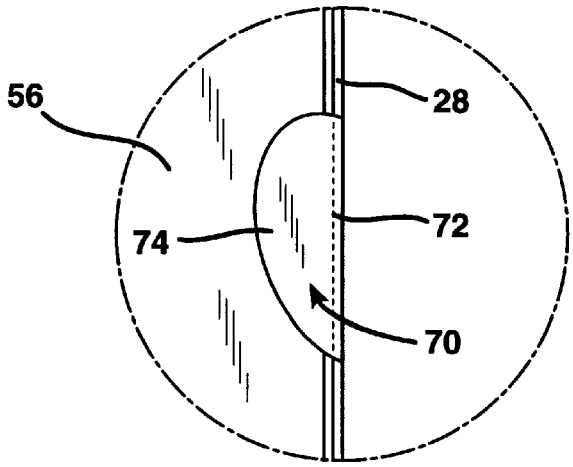
FIG. 7 is a detail indicated at 7 in FIG. 6.

FIG. 6 illustrates a photographic album storage case 100 that includes all of the component elements of the photographic album case 10 and which also includes restraining tabs 70 on opposite sides of the open end 34 of the shell 14. One of the restraining tabs 70 is visible in FIG. 6 and is illustrated in detail in FIG. 7. As shown in FIG. 7, the restraining tab 70 serves as a catch member and has an anchored end or margin 72 secured to the open end the side wall panel 28 of the shell 14. A free end 74 of the restraining tab 70 is directed back toward the closed end panel 38 of the shell 14. The restraining tab 70 thereby serves as a catch member that engages and restrains the edge of the return panel 56 of the retainer 16 that is located at the open end 34 of the shell 14. Another restraining tab 70, having a mirror image construction to that depicted in FIGS. 6 and 7, is secured to the open end of the display wall panel 24 and engages and restrains an edge of the display retaining panel 60 at the open end 34 of the shell 14. The restraining tabs 70 ensure that the display retaining panel 60 remains pressed against the display wall panel 24 of the shell 14 and that the return panel 56 of the retainer 16 is held pressed against the opposing side wall panel 28 of the shell 14. This prevents any interference by the retainer 16 with insertion of the photographic album 12 in the manner depicted in FIG. 2.

Figure 8:
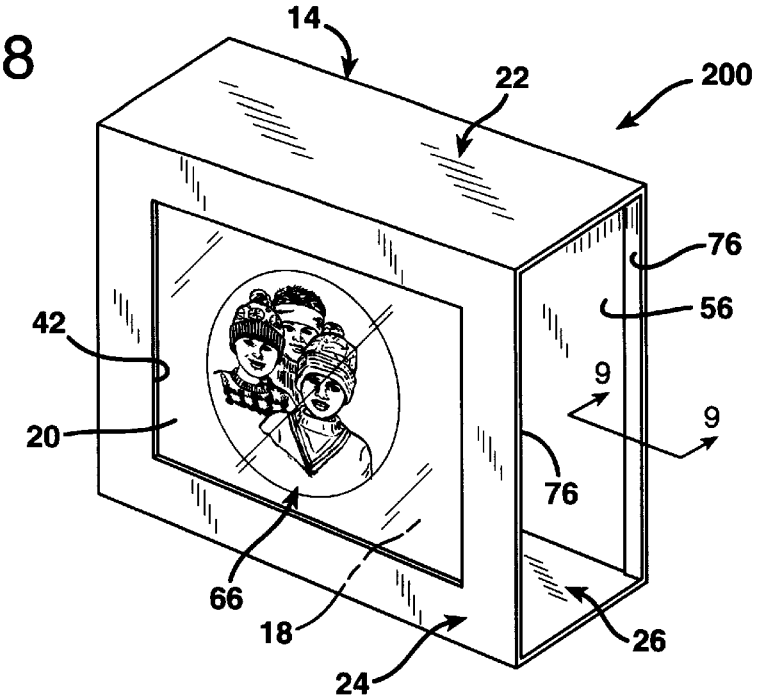
FIG. 8 is a perspective view illustrating another alternative embodiment of a storage container according the invention.

FIG. 8 illustrates an album case 200 which is a further alternative embodiment according to the invention. The album case 200 has all of the components elements of the album case 10 shown in FIG. 2, but in addition has a catch member that extends the along the edges of the outer ends of the display wall panel 24 and the opposing wall panel 28 at the open end 34 of the shell 14. The catch member of the album case 200 is formed by end margins 76 at the open ends of the display wall panel 24 and the opposing wall panel 28. The end of margins 76 are extensions that initially project about one-half of an inch beyond the open ends of the top and bottom wall panels 22 and 26, but which are folded back and secured by adhesive to the adjacent inner surfaces 30 of the structure of the display wall panel 24 and the opposing wall panel 28. These folded back edge margins 76 thereby form raised lips that are secured to the inner surfaces 30 of at least some of the inner ends of the walls of the shell 14, specifically the inner ends of the display wall panel 24 and the opposing wall panel 28.

Figure 9:
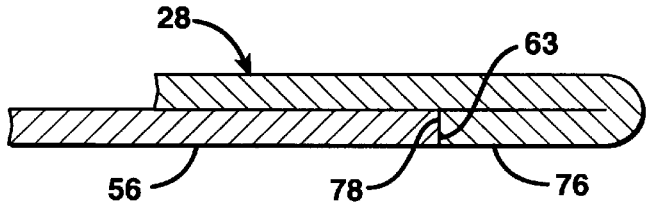
FIG. 9 is a transverse detail taken along the lines 9—9 of FIG. 8.

The raised lips formed by the folded back and adhesively secured edge margins 76 thereby form abutting ledges 78, against which the outwardly facing edges 61 and 63 of the retainer 16 reside in abutment, as best illustrated in FIG. 9. The outwardly directed springiness of the display retaining panel 60 and the return panel 56 ensures that the retainer panels 60 and 56 reside flat against the wall panels of the shell 14 against which they bear, respectively. The abutting engagement of the ledges 78 of the lips 76 and the edges 61 and 63 of the retainer panels 60 and 56, respectively, ensure that the retainer 16 remains in position within the shell 14 unless purposefully removed therefrom.

Figure 10:
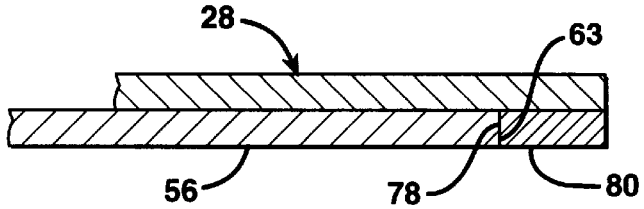
FIG. 10 is a sectional detail illustrating an alternative form of catch member to that depicted in FIG. 9.

FIG. 10 illustrates a modification of the catch arrangement depicted in FIGS. 8 and 9. Specifically, in FIG. 10 the lips 80 that are secured by adhesive to the open ends of the wall panels 24 and 28 are not formed by folded margins extending from those wall panels, but rather by separate, narrow strips of stiff plastic, card stock, or some other stiff material. The narrow strips forming the lips 80 also provide inwardly facing abutment ledges 78 that engage the corresponding outwardly facing abutment ledges 61 and 63 of the retainer panels 60 and 56, respectively.

Figure 11:
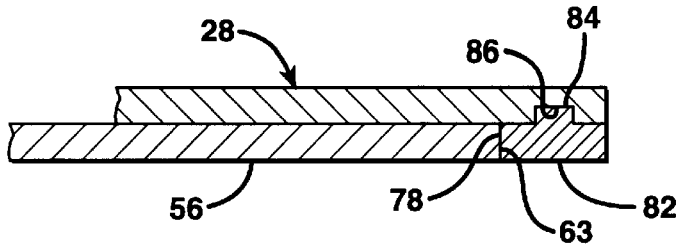
FIG. 11 is a sectional detail illustrating still another alternative form of catch mechanism to those depicted in FIGS. 9 and 10.

FIG. 11 illustrates still another variation of a catch mechanism in which a lip 82 is formed as a narrow, separate strip, preferably between about one-sixteenth and one-eighth of an inch thick and about one-half of an inch in width. The lips 82 may be secured by adhesive to the open ends of the shell wall panels 24 and 28. Alternatively they can be constructed to snap together into the channels 86. The lips 82 differ from the lips 80 in that they have raised, outwardly directed ribs 84 that reside in corresponding channels 86 defined in the structures of the shell walls 24 and 28, proximate the open ends thereof. The channels 86 can extend throughout the height of the wall panels 24 and 28, parallel to the closed end panel 38. Alternatively, they may extend only a short distance, or even be constructed as detent depressions. The lips 82, like the lips 76 and 80, also form abutment ledges 78 that engage the corresponding outwardly facing edges 61 and 63 of the retainer display panel 60 and the retainer return panel 56.

Figure 12:
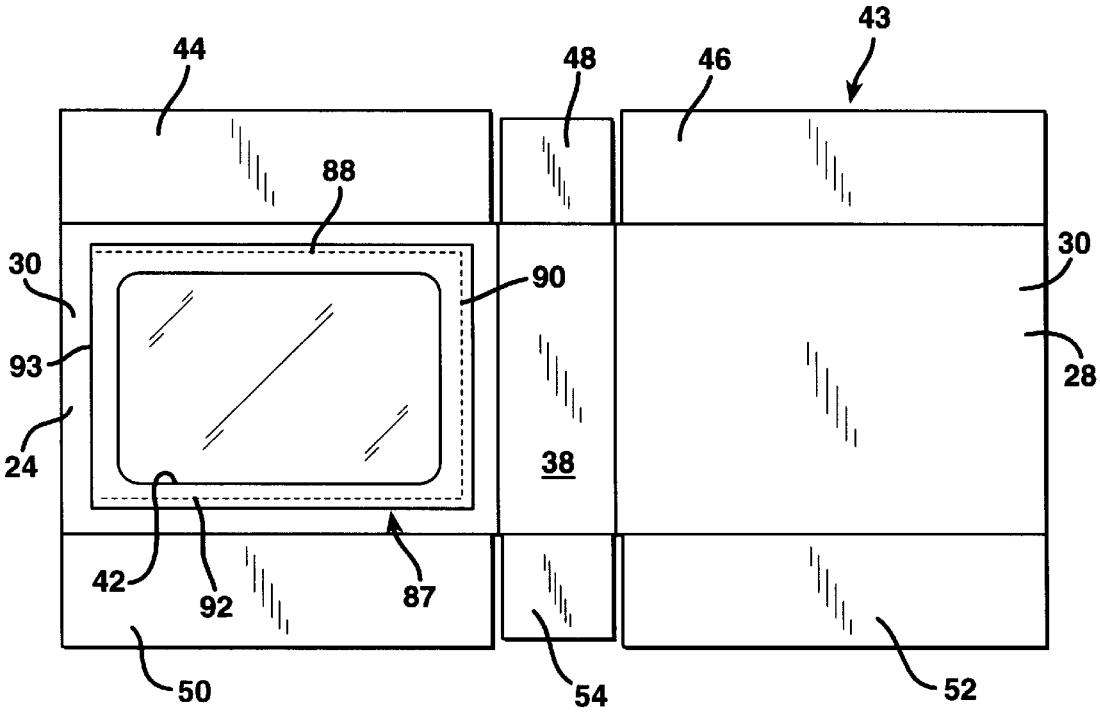
FIG. 12 is a plan view illustrating an alternative construction of a storage container shell to that depicted in FIG. 4.

FIG. 12 illustrates an alternative arrangement for constructing an album case shell according to the invention. The flat sheet of stiff stock 43 depicted in FIG. 12 is the same as that shown in FIG. 4 and which is used in the construction of the shell 14. However, instead of employing a single transparent sheet 20 that is inserted separately into the shell 14, the shell 14 is provided with a display sheet mounting pocket 87 that is sealed to the inner surface 30 of the display wall 24. The pocket 87 is formed of two thin layers of transparent material heat sealed together and thermally sealed or sealed by adhesive along three of its four edges as indicated by the sealing lines 88, 90, and 92 in FIG. 12. The two sheets of transparent material are left unsealed at their open ends 93 so as to allow insertion of the display sheet 18 between the two plies of transparent material forming the pocket 87 with the photograph 66 thereon facing outwardly through the window 42 of the display wall 24. The outer ply of the pocket 86 thereby serves as a transparent, protective shield for the visual display sheet 18.

Figure 13:
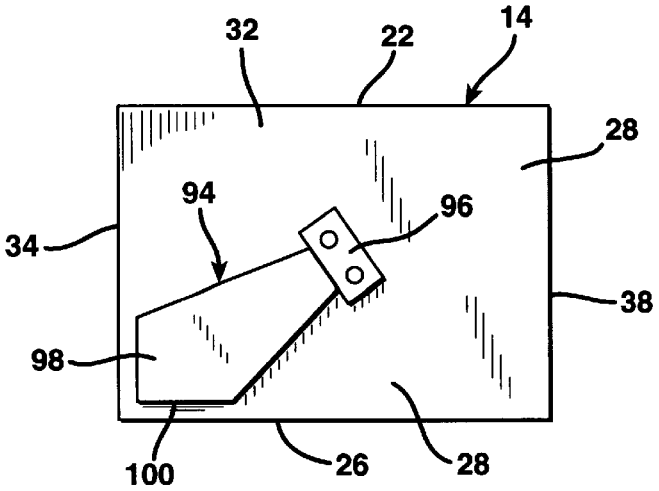
FIG. 13 illustrates a storage container according to the invention constructed with a retractable stand.

As illustrated in FIGS. 1 and 2, the shell 14 is normally oriented for display so that the wall panels 22 and 26 respectively form mutually opposing top and bottom walls. The display wall 24 and the opposing back wall 28 serve as mutually opposing side walls. Preferably, a foldable stand 94, illustrated in FIG. 13, is secured to the outer surface 32 of the other opposing wall, namely the back wall 28 opposite the display wall 24. The foldable stand 94 includes an attachment pad 96 that is secured to the outside 32 of the back wall 28 and a leg 98 that extends downwardly and forwardly from the anchoring pad 96. The leg 98 is inclined downwardly at an angle relative to the lower edge of the back wall 28 so that it can be folded outwardly and thereby deployed to project outwardly and downwardly to a surface upon which the shell 14 rests. When the stand leg 98 is rotated outwardly away from the outer surface 32 of the back wall 28, the lower edge 100 of the stand leg 98 reaches a horizontal surface upon which the shell 14 rests. The leg 98 thereby supports the shell 14 so that the opposing side walls, namely the display wall 24 and the opposing back wall 28 are held oriented in an upright disposition, as illustrated in FIGS. 1 and 2.

Figure 14:
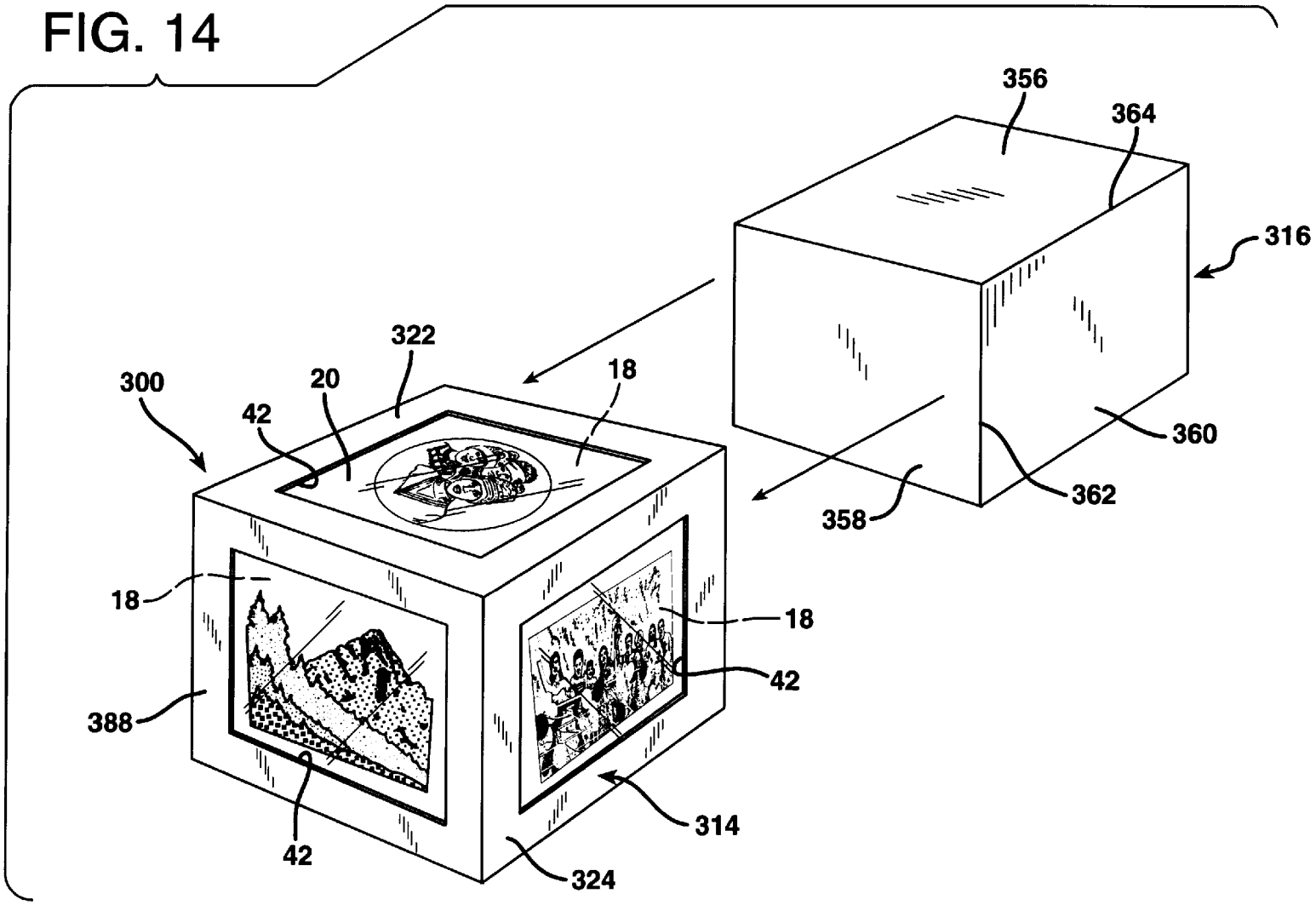
FIG. 14 illustrates an alternative embodiment of a storage container according to the invention having a plurality of visual display panels.

The album case of the invention is not limited to embodiments which include only a single display wall in the shell 14. FIG. 14 illustrates an alternative embodiment of a storage container 300 according to the invention in which the shell 314 includes three display walls 322, 324, and 338. The display wall 338 is the transverse end wall of the shell 314, which is located opposite the open end (not visible) of the album case 300. The retainer 316 that is employed in the album case 300 does not have a U-shape like the retainer 16, but rather is formed of at least three panels that conform to the shape of and press outwardly against the shell walls 322, 324, and 338. As is evident, the end wall panel 338 of the shell 314 is considerable wider than the end panel 38 of the shell 14. As a consequence, the album case 300 may accommodate three or more photo albums 12 of the type depicted in FIG. 2. The separate flat retainer display panels of the retainer 316 employed in the album case 300 are delineated by folds 362 and 364 in the retainer 316, as depicted in FIG. 14. Each of the distinct, flat retainer display panels 356, 358, and 360 respectively conforms to the shape of and covers the inner surface of a single one of the display walls 322, 324, and 338. Specifically, the retainer wall 356 conforms to the shape of and covers the inner surface of the display wall 322 of the shell 314, while the retainer display panel 358 conforms to and covers the inner surface of the end wall 338. The retainer display panel 360 conforms to the shape of and covers the inner surface of the display wall 324.

Figure 15:
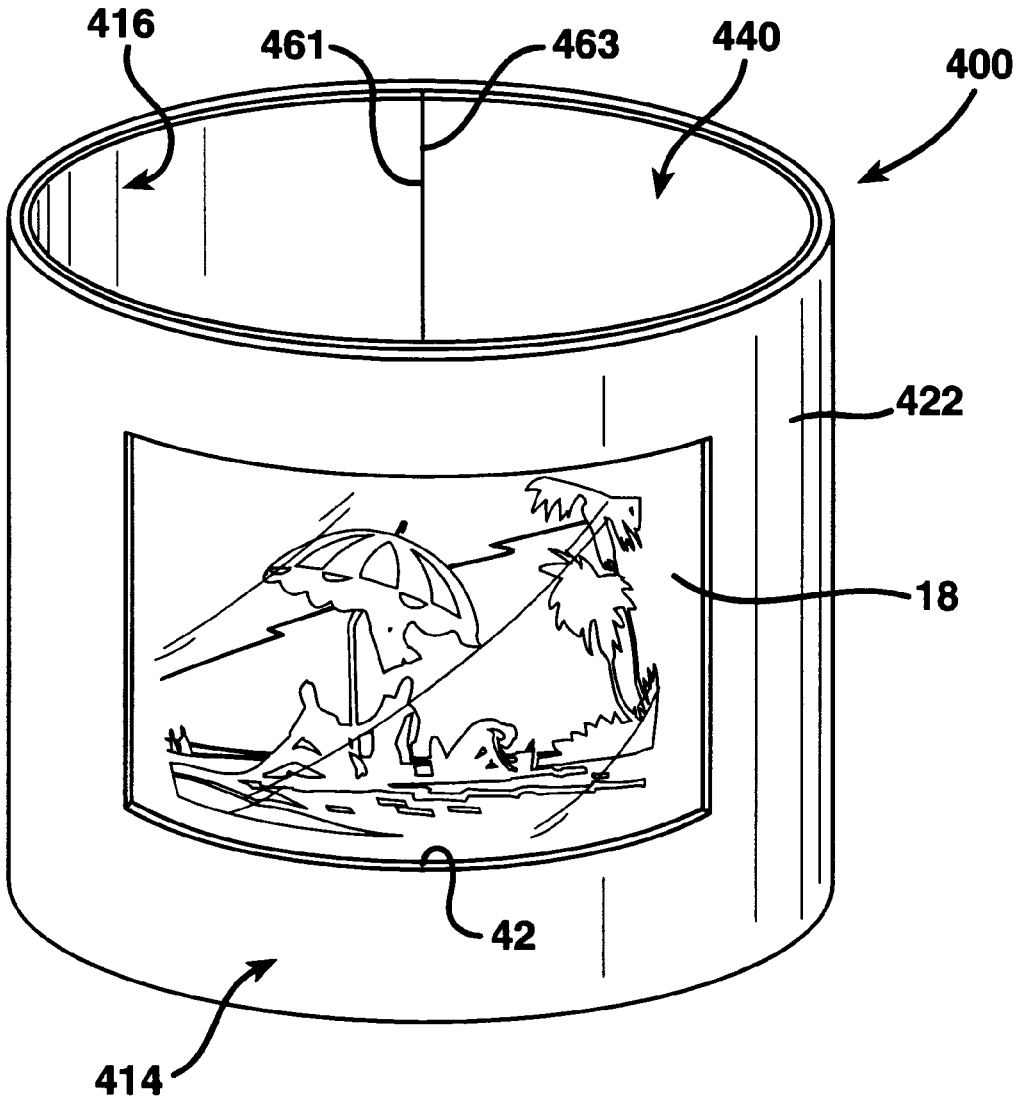
FIG. 15 Illustrates still another alternative embodiment of a storage container according to the invention.

The storage container of the invention may assume shapes other than rectilinear shapes. For example, FIG. 15 illustrates a storage container 400 wherein the enclosing walls 422 form a cylindrical structure. The storage cavity 440 has the shape of a cylindrical prism. The display retainer 416 is formed of a single, resilient rectangular sheet that is bent into the shape of a cylinder and is positioned in the storage cavity 440 so that a pair of opposing edges 461 and 463 of the resilient rectangular sheet forming the retainer 416 meet in longitudinal, linear abutment with each other. Alternatively, a longitudinal rib could be formed on the inner surface of the enclosing wall 422. The opposing edges 461 and 463 could then bear in abutment against this rib. In either case, the resilient rectangular sheet forming the retainer 416 exerts an outward radial force on the walls 422 of the shell 414 to press thereagainst throughout the inner surfaces of the walls 422. The storage container 400 may, for example, be utilized to store one or more photographic slide carrousels, stacked one atop another.

Many variations and modifications of the invention are also possible. For example, instead of securing the transparent pocket 86 to the inner surface of the shell 14 in the manner depicted in FIG. 12, a transparent pocket could be formed on the outwardly facing surface of the display retaining panel 60 of the retainer 16. In such an arrangement, the display pocket could be formed as a single ply of transparent material secured to the outwardly facing surface of the display retaining panel 60 by adhesive, thermal sealing, or otherwise. The display sheet 18 could then be inserted into the pocket formed between the single ply of transparent material secured to the outwardly facing surface of the display retaining panel 60, and the structure of the display retaining panel 60 itself. In such an arrangement the display sheet 18 would be held in essentially the same position on the display retaining panel 60 as in the embodiment of FIGS. 1 and 2.

Numerous other variations and modifications of the invention will become readily apparent to those familiar with article storage devices, particularly photographic album cases. For example, the open end of the shell could be provided with a closure flap. Accordingly, the scope of the invention should not be construed as limited to this specific embodiments depicted and described herein.

I claim:

1. A storage container comprising:

an outer shell formed with laterally enclosing walls having inner and outer surfaces and opposing open and closed ends, and said shell includes a transverse, closed end panel having inner and outer surfaces and extending across said closed ends of said laterally enclosing walls, thereby defining a storage cavity therewithin, and said open ends of said walls form and surround an open entry to said storage enclosure, and at least one of said walls is a display wall within which a window is formed;

a stiff, inner display retainer that fits into said storage cavity and which conforms to the shape of and covers the inner surface of said display wall and said display retainer extends beyond said display wall to extend across another of said inner surfaces immediately adjacent thereto; and a visual display sheet located between said display wall and said display retainer, whereby said display retainer presses against said inner surface of said display wall and said another of said inner surfaces immediately adjacent thereto and holds said visual display sheet against the area of said inner surface of said display wall surrounding said window therein.

2. A storage container according to claim 1 wherein said retainer is formed of a sheet of stiff, resilient material that is divided into a display panel and a support panel that meet at a linear articulated connection therebetween, and said retainer panels are resiliently biased apart from each other.

3. A storage container according to claim 1 wherein mounting slits are formed in said display panel and said visual display sheet is inserted through said mounting slits in said retainer, whereby said visual display sheet is mounted upon said retainer.

4. A storage container according to claim 2 further comprising a transparent, protective sheet interposed between said inner surface of said display wall and said visual display sheet.

5. A storage container according to claim 1 wherein said display retainer is comprised of at least three distinct flat panels joined together.

6. A storage container according to claim 1 wherein said storage cavity has the shape of a rectangular prism and said display retainer is formed of at least three panels, including a display retaining panel which conforms to the shape of and completely covers said inner surface of said display wall, a web panel that extends beyond said display wall and which completely covers an inner surface of said shell immediately adjacent to said display wall, and a bracing panel joined to said web panel and residing in contact with a wall of said shell parallel to said display wall.

7. A storage container according to claim 6 wherein said shell is comprised of at least one catch member at said open end thereof that engages said display retainer and holds it against at least some of said inner surfaces of said shell.

8. A storage container according to claim 7 wherein said catch member is a restraining tab having an anchored end secured to said open end of one of said walls, and a free end directed toward said closed end panel, whereby said catch member engages and restrains an edge of said display retainer.

9. A storage container according to claim 7 wherein said catch member is formed by raised lips secured to said inner surfaces of at least some of said inner ends of said walls, and said display retaining panel and said bracing panel have outer edges that reside in abutment against said raised lips.

10. A storage container according to claim 5 wherein said shell defines a plurality of display walls as aforesaid and said retainer includes a plurality of flat retainer display panels each of which respectively conforms to the shape of and covers the inner surface of a single one of said display walls.

11. A storage container according to claim 1 wherein said enclosing walls form a cylindrical structure and said storage cavity has the shape of a cylindrical prism, and said display retainer is formed of a single, resilient, rectangular sheet that is bent into the shape of a cylinder, and which is positioned in said storage cavity so that a pair of opposing edges of said resilient, rectangular sheet reside in longitudinal, linear abutment, and said resilient, rectangular sheet exerts an outward radial force on said walls of said shell to press thereagainst throughout said inner surfaces of said walls.

12. A storage container according to claim 1 further comprising a display sheet mounting pocket sealed to said inner surface of said display wall for receiving said visual display sheet therewithin.

13. A storage container according to claim 1 wherein said enclosing walls of said shell include mutually opposing top and bottom walls and mutually opposing side walls, wherein said display wall serves as one of said opposing side walls, and further comprising a foldable stand secured to said outer surface of the other of said opposing side walls, and said foldable stand is deployable to project outwardly and downwardly to a surface upon which said shell rests to support said shell so that said opposing side walls are oriented in an upright disposition.

14. An album case comprising:

a shell having a closed end with an end panel having inner and outer surfaces, an opposite open end, and a plurality of wall panels having inner and outer surfaces and extending between said closed end panel and said open end, wherein at least one of said panels is a display panel in which a window is defined;

a stiff display retainer having a plurality of distinct, flat retainer panels joined together, one of which is coextensive in area with and presses against said inner surface of said display panel and another of which extends across and presses against said inner surface of another of said panels of said shell immediately adjacent to said display panel; and a display sheet interposed between said inner surface of said display panel and said retainer panel that presses against said inner surface of said display panel.

15. An album case according to claim 14 wherein said retainer is constructed from a single sheet of stiff, flat material delineated into said retainer panels by at least one linear fold.

16. An album case according to claim 14 wherein said retainer includes at least three retainer panels formed from a single sheet of stiff stock delineated into said retainer panels by articulated joints therebetween.

17. An album case according to claim 14 further comprising at least one catch member on said shell at said open end thereof, and said catch member engages said retainer to hold it within said shell.

18. An album case comprising:

a shell formed with four wall panels having inner and outer surfaces, each wall panel having an open end and a closed end, and a closed end panel having inner and outer surfaces secured to all of said closed ends of said wall panels to extend transversely thereacross, whereby said shell defines a hollow album enclosure, and wherein at least one of said wall panels is a display wall panel within the area of which a window is defined;

a sheet of stiff material forming a display retaining panel that is disposed to face said inner surface of said display wall panel, and a support panel that projects from said display retaining panel and is disposed to face one of said inner surfaces of said shell immediately adjacent said display wall panel; and a display sheet interposed between said display retaining panel and said inner surface of said display wall panel, and said display retaining panel holds said display sheet pressed against said inner surface of said display wall panel.

19. An album case according to claim 18 wherein said display retaining panel is coextensive in area with said inner surface of said display wall panel and said support panel is coextensive in area with the aforesaid inner surface of said shell immediately adjacent said display wall panel.

20. An album case according to claim 18 wherein said shell is provided with catch members at said open end of said display wall panel and at said open end of at least one other of said wall panels and said catch members engage said retainer and hold it within said shell.

* * * * *